US005372284A

United States Patent [19]

Mock

[11] Patent Number: 5,372,284

[45] Date of Patent: Dec. 13, 1994

[54] HINGED CLOSURE UNIT FOR A CONTAINER WITH FILM BREAKAGE FOR FIRST OPENING AND PREDETERMINED OPEN POSITIONS

[75] Inventor: Elmar Mock, Biel/Bienne, Switzerland

[73] Assignee: Tetra Alfa Holdings S.A., Pully, Switzerland

[21] Appl. No.: 986,913

[22] Filed: Dec. 8, 1992

[30] Foreign Application Priority Data

| | | | |
|---|---|---|---|
| Dec. 12, 1991 | [CH] | Switzerland | 03688/91 |
| Dec. 12, 1991 | [CH] | Switzerland | 03693/91 |
| Dec. 12, 1991 | [CH] | Switzerland | 03694/91 |
| Dec. 12, 1991 | [CH] | Switzerland | 03695/91 |

[51] Int. Cl.[5] ..... B67B 5/00

[52] U.S. Cl. ..... 222/153; 222/541; 222/556

[58] Field of Search ..... 222/541, 556, 23, 153; 220/258, 259, 265, 269, 339, 359

[56] References Cited

U.S. PATENT DOCUMENTS

| | | | |
|---|---|---|---|
| 3,443,005 | 10/1965 | Braun | 264/245 |
| 3,917,789 | 11/1975 | Heisler | 264/219 |
| 3,964,609 | 6/1976 | Perella | 220/254 |
| 4,082,201 | 4/1978 | Bittel | 220/339 |
| 4,171,749 | 10/1979 | Obrist et al. | 222/541 |
| 4,391,385 | 7/1983 | Rausing | 220/269 |
| 4,397,401 | 8/1983 | Ueno et al. | 220/260 |
| 4,424,920 | 1/1984 | Tada | 222/153 |
| 4,462,504 | 7/1984 | Roth et al. | 220/214 |
| 4,669,640 | 6/1987 | Ando et al. | 222/541 |
| 4,711,372 | 12/1987 | Gach | 222/23 |
| 4,735,335 | 4/1988 | Torterotot | 220/359 |
| 4,770,325 | 9/1988 | Gordon et al. | 222/541 |
| 4,795,065 | 1/1989 | Ashizawa et al. | 220/269 |
| 4,858,793 | 8/1989 | Stone | 222/541 |
| 4,887,747 | 12/1989 | Ostrowsky et al. | 222/556 |
| 4,892,217 | 1/1990 | Shastal | 222/541 |
| 4,949,882 | 8/1990 | Take | 222/541 |
| 4,986,465 | 1/1991 | Jacobsson et al. | 229/123.3 |
| 4,988,012 | 1/1991 | Shastal | 220/258 |
| 5,054,641 | 10/1991 | Sato | 220/270 |
| 5,062,542 | 11/1991 | Morton | 220/254 |
| 5,197,618 | 3/1993 | Goth | 215/232 |
| 5,201,440 | 4/1993 | Gross | 222/153 |
| 5,271,519 | 12/1993 | Adams et al. | 222/541 |

FOREIGN PATENT DOCUMENTS

| | | |
|---|---|---|
| 0079676 | 10/1982 | European Pat. Off. . |
| 0224593 | 5/1986 | European Pat. Off. . |
| 0268690 | 6/1987 | European Pat. Off. . |
| 0316269 | 10/1988 | European Pat. Off. . |
| 2647088 | 5/1989 | France . |
| 1941479 | 8/1969 | Germany . |
| 2636259 | 8/1976 | Germany . |
| 61-47223A | 8/1984 | Japan . |
| WO84/00531 | 2/1984 | WIPO . |
| WO90/14287 | 11/1990 | WIPO . |

*Primary Examiner*—Andres Kashnikow
*Assistant Examiner*—Philippe Derakshani
*Attorney, Agent, or Firm*—Frishauf, Holtz, Goodman & Woodward

[57] ABSTRACT

A closure unit consists substantially of a closure part (2) and a pouring part (3). It has at least two areas of which each one consists of a thermoplastic material, wherein the material of one area differs from the material of a neighboring other area. The closure part (2) has an indicator (8) forming part of the area of one material and extending over the outer surface of the pouring part which in the vicinity of the indicator provides part of an area of a different material. The indicator has a predetermined breaking location (85) or a connection with the pouring part which cannot be reconnected and, on first opening the closure unit it irreversibly brought from a first attitude or position into a second attitude or position.

15 Claims, 6 Drawing Sheets

HINGED CLOSURE UNIT FOR A CONTAINER WITH FILM BREAKAGE FOR FIRST OPENING AND PREDETERMINED OPEN POSITIONS

CLOSURE UNIT

The invention is in the field of the packing industry and relates to a closure for a container for handling and storing flowable products. The closure Unit is made of thermoplastic synthetic material and comprises a pouring part with a substantially tubular spout, a base for affixing it to the container and a closure part closing the opening of the spout.

Containers for liquids such as for example, metal cans or coated cardboard receptacles are frequently made with a resealable opening. For easy pouring closure units are preferably made from plastic and comprise a pouring part with a pouring opening and a closure part closing the pouring opening of the pouring part. The closure units are fitted in an opening of the container. Two Swiss patent applications 2739/91-2 and 2740/91-9, PCT application No. WO 93/05945 and pending U.S. patent application Ser. No. 08/050,417 filed May 14, 1993 and based on the aforesaid PCT application all describe such closure units. Those closure units are molded by a multimaterial injection molding process and are made from at least two materials differing with regards to at least one characteristic.

In the case of packed products, particularly foods, the purchaser generally wishes to know whether the product pack has already been opened, or whether it is still intact. Most manufacturers solve this problem by using packs that combine the pack with a tear-open element which performs the mechanical function of the closure.

A disadvantage of the known solutions is that after the first opening the closure quality is often impaired because, for example, part of the closure function is destroyed or the anchoring of the closure part is no longer fully maintained. Another disadvantage is that usually the tear-open element requires an additlnal manufacturing or mounting step.

SUMMARY OF THE INVENTION

The object of the invention is to provide a closure unit, on which a visible and irreversible indicator shows, whether the closure unit is new (never yet opened) or reclosed. The change of state of the indicator taking place with the first opening of the closure unit must not impair the closing or sealing function of the closure unit. The indicator needs to be manufacturable without additional measures during closure unit manufacture and virtually in the same operation in which the closure unit is made.

Briefly, the closure unit according to the invention has at least two areas each consisting of one material. The materials of two areas differ with regard to at least one characteristic. At least one of the areas reaches into both parts (closure part and pouring part) of the closure unit. For the function of an indicator one of the areas has a portion which extends from the closure part on the outer surface of the closure unit to the pouring part where the closure part is anchored. The area portion serving as indicator consists of one material, the region of the outer surface of the closure unit on which the indicator extends consists of another material. The indicator and its anchorage are so designed that, at the first opening of the unit, either the indicator is broken or the anchorage is irreversibly disconnected. If the two materials differ in color the state of the indicator (intact/anchored or broken/loose) is easily visible. With this change of state of the indicator the objective of not impairing the closing and sealing function of the closure unit is fulfilled, while the area portion serving as indicator does not take part in the closing or sealing function.

The closure unit according to the invention is advantageously manufactured by a multimaterial injection molding process. Only such a process allows the pouring of the closed closure unit with an intact indicator in one process step. The multimaterial molding process consists in molding a blank from a first material using a first mold. Then the mold is at least partially exchanged or displaced away from the blank and a second material molded, the blank at least partly serving as mold so that the second material is molded partly around the blank. In such a way areas of different materials are formed with contact surfaces where the two materials according to the molding parameters and/or the material pairing adhere together more or less. In particular, means for interlocking connections can be molded in a connected state. Obviously the multimaterial molding process is not limited to the molding of two materials. Three or more materials can be molded onto or around each other in the same way.

THE DRAWINGS

The invention is described in greater detail hereinafter by way of examples of a number of embodiments of the closure unit, with reference to the attached drawings, wherein the following are repesented, in successive figures.

DESCRIPTION OF THE ILLUSTRATED EMBODIMENTS

Figure 1:
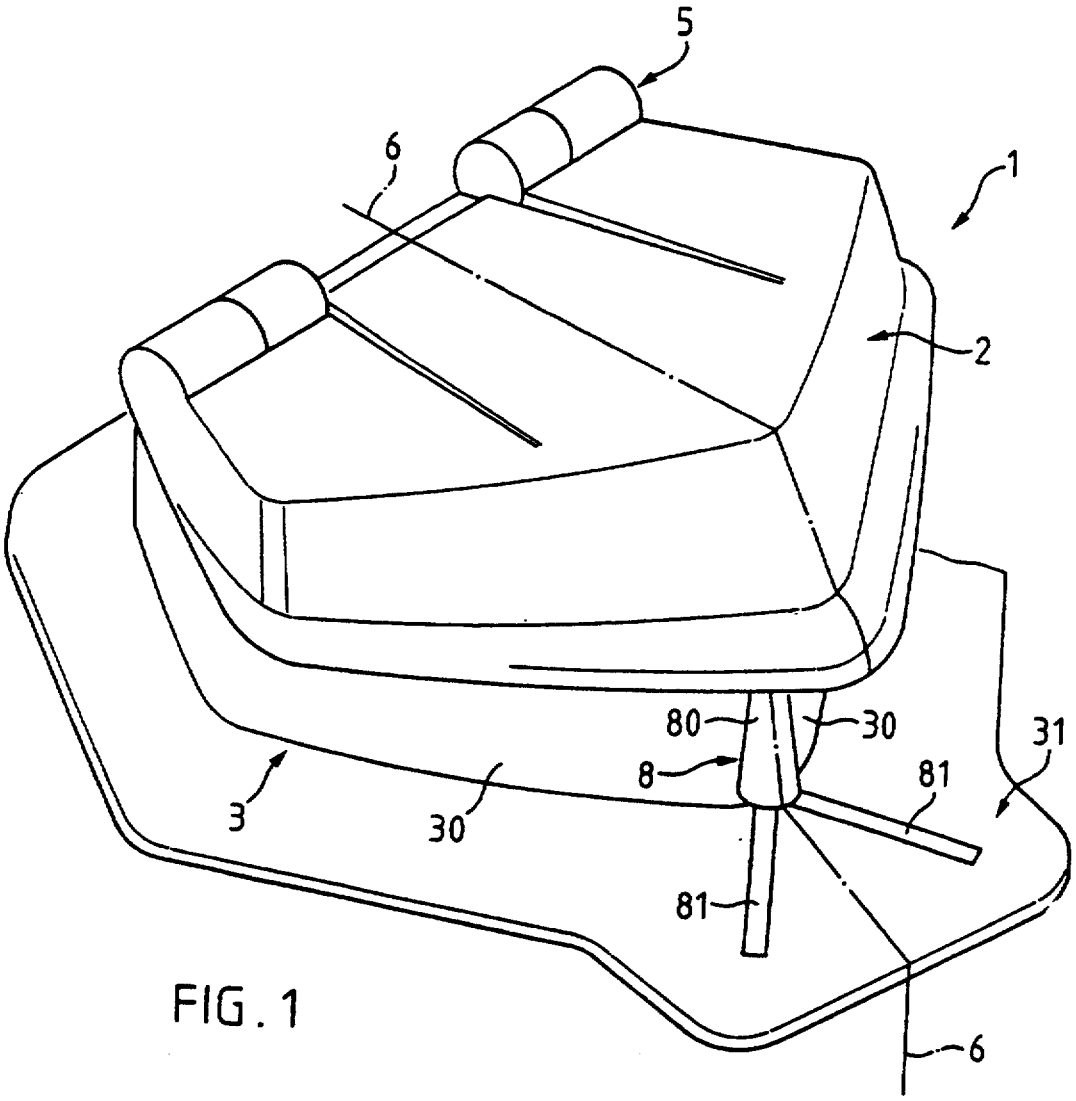
FIG. 1 is an example of an embodiment of the closure unit according to the invention, in perspective view.

FIG. 1 shows in perspective view an exemplified embodiment of the closure unit 1 according to the invention. It consists substantially of a closure part 2 and a pouring part 1, which are connected by a hinge 5. The pouring part 3 shows a roughly tubular spout 30 whose one opening (pouring opening) is covered in the closed state of the unit by the closing part 2, and which in the region of the other opening carries a base 31 serving for fastening the unit on a container. Further visible is an indicator 8, that consists substantially of a web 80 and an anchorage 81 which has the form of a fork. The web 80 extends from the closure part over the outer surface of the spout 30.

Figure 2:
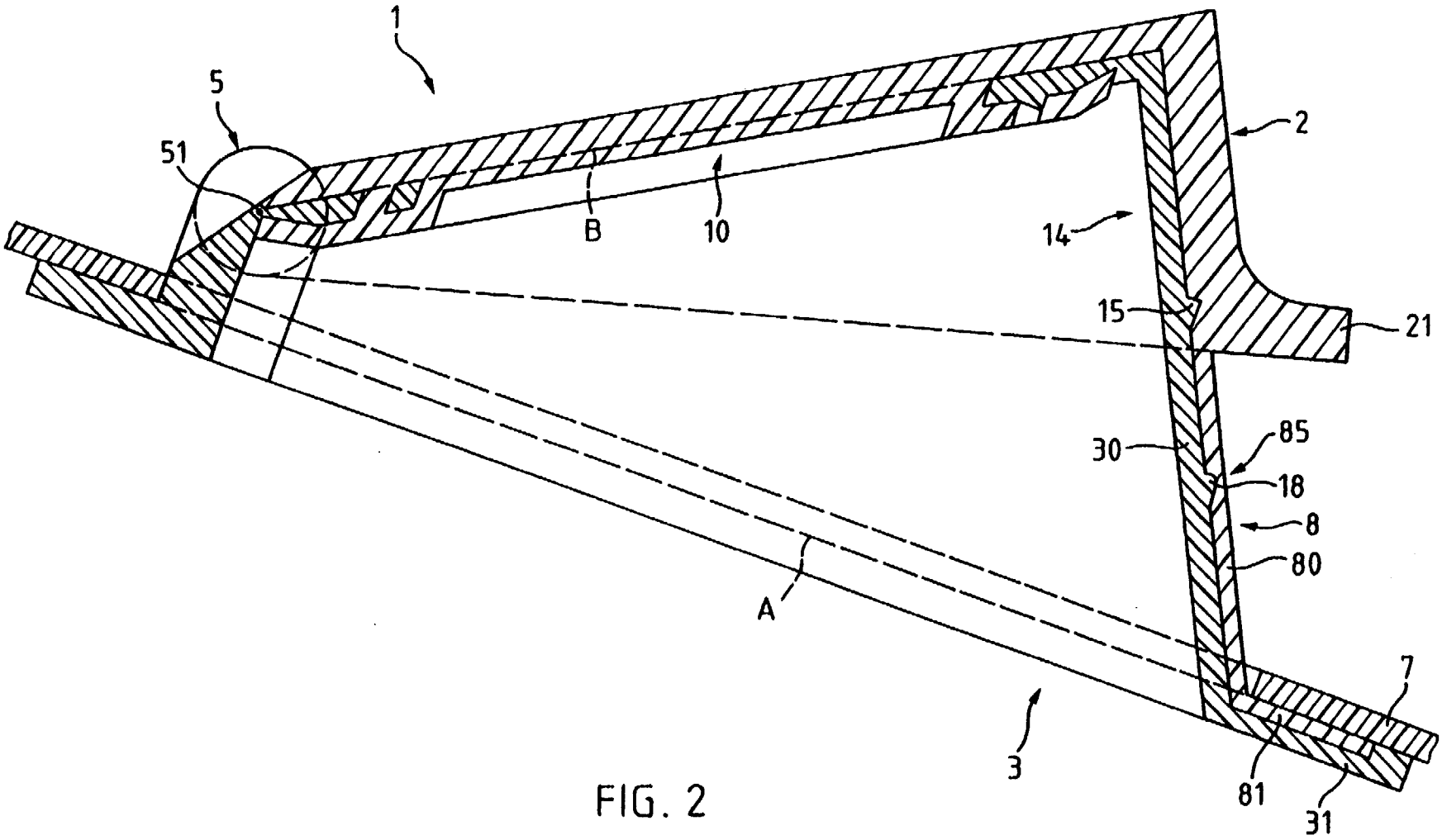
FIG. 2 is the embodiment according to FIG. 1 in section perpendicular to the plane of the pouring opening.

FIG. 2 shows the same closure unit as FIG. 1 cut along a line indicated by 6 in FIG. 1. Visible is a container wall 7 which in the region of the container opening is positioned above the base 31 and fixed to this by welding. The symbol designates a plane in which the base 31 and the opening of the spout 30 facing the container extend. The symbol B designates a plane in which the pouring opening extends which is covered by the closure part. The axis 51 of the hinge 5 which connects the closure part pivotally with the pouring part, lies approximately in this plane B. Further visible is the closure part, which overlaps the pouring part partially in a region 14 extending beyond the plane B. On the outer surface of the spout 30 there is a cam 15 protruding against the closure part 2 serving as safety element. The closure part shows in the same region an opening lip 21, serving for easy opening of the unit. Shaped onto this lip 21 is the indicator 8, substantially consisting of the web 80 and the anchorage 81. The anchorage 81 extends between the base 31 and the container wall 7 and is fixed in this position by welding.

Between the web 80 which has a substantially smooth outer surface, and the outer surface of the spout 30 there is a further cam 18 protruding from the spout 30 and reducing the cross-cut section of the web 80. The area of the small cross-cut section forms a predetermined breaking point 85. The predetermined breaking point has to be dimensioned in such a way that it is less strong than the connection between the anchorage 81 with the base 31 and/or the container wall 7.

For opening purposes the closure part 2 is gripped on the lip 21 and drawn upwards over the cam 15 and the pouring opening 10. This gives a movement, which can be referred to as peeling, because the closure part 2 is detached from the pouring part 3 except at the hinge 5 and, accompanied by simultaneous deformation, is drawn off in the manner of an orange peel. At the same time the web 80 is broken at the predetermined breaking point 85.

On closing the closure part 2 the latter is also deformed before passing into the closed position. The deformation is also necessary because the lip 21 must be drawn over the cam 15 so that it catches thereon. As the web 80 adheres to the spout 30 only lightly or not at all, the broken state of the indicator is easily visible in particular if the color of the indicator differs from the color of the spout surface.

The particular form of the cam 18, being rounded at its top, rising an one side steeply on the other side less steeply from the surface of the spout 30 is chosen, because it can be molded with simple molds.

Figure 3:
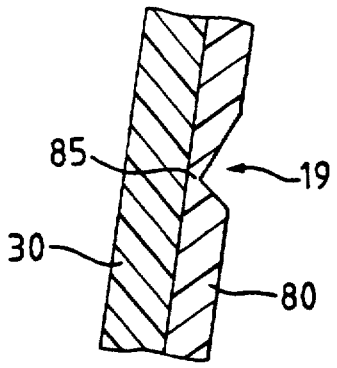
FIG. 3 is a further example of an embodiment of the indicator, as a detail in section.

FIG. 3 shows, as a detail across-cut section analogous to FIG. 2 of a further embodiment of a predetermined breaking point 85 on a web 80. In this case the outer surface of the web 80 shows a depression 19, whereas the surface of the spout 30 is smooth. The web 80 may be positioned anywhere on the outer surface of the spout 30. In the same way more than one web may be provided.

After breakage of the web 80 one part of it remains attached to the closure part 2, but it does not impair its closing or sealing function. On the other hand the predetermined breaking point can be positioned immediately beneath the lip 21, so that no part of the web 80 remains connected to the lip 21.

Figure 4:
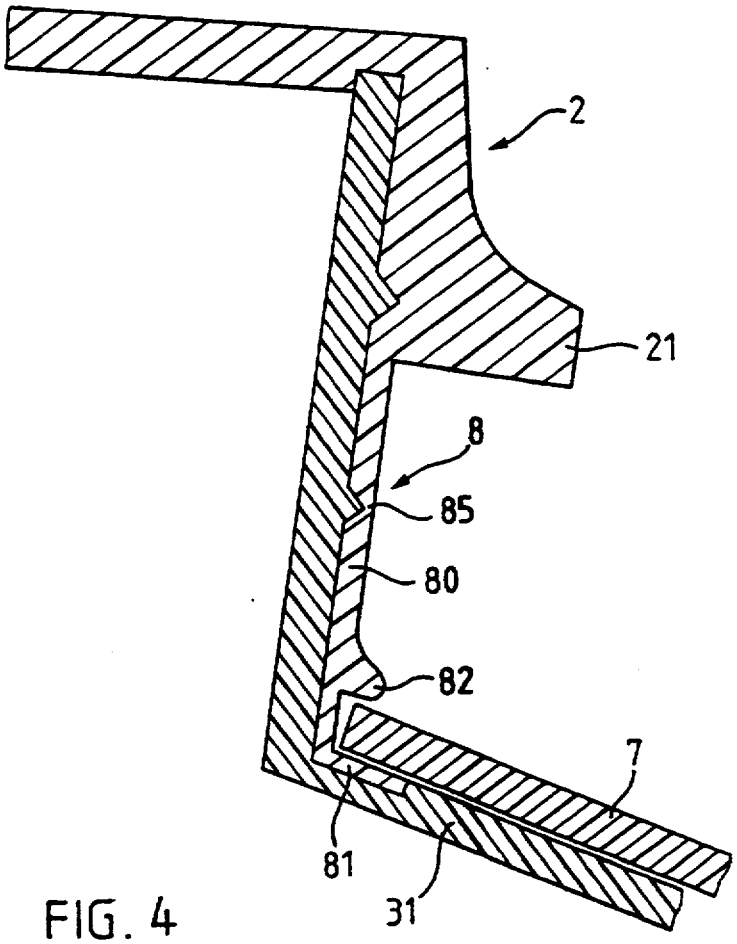
FIGS. 4 and 5 are further embodiments of indicators with additional functions, in section.

FIG. 4 shows in the same section as FIG. 2 a further embodiment of the indicator 8. This one again has a web 80 with a predetermined breaking point 85 and an anchorage 81 extending between the base 31 and the container wall 7. The web is shaped onto the closure part 2, e.g. in the region of the lip 21. In the region of the anchorage the web 80 has a further (positioning) cam 82, which serves for positioning the closure unit on the container before affixing it by welding.

Figure 5:
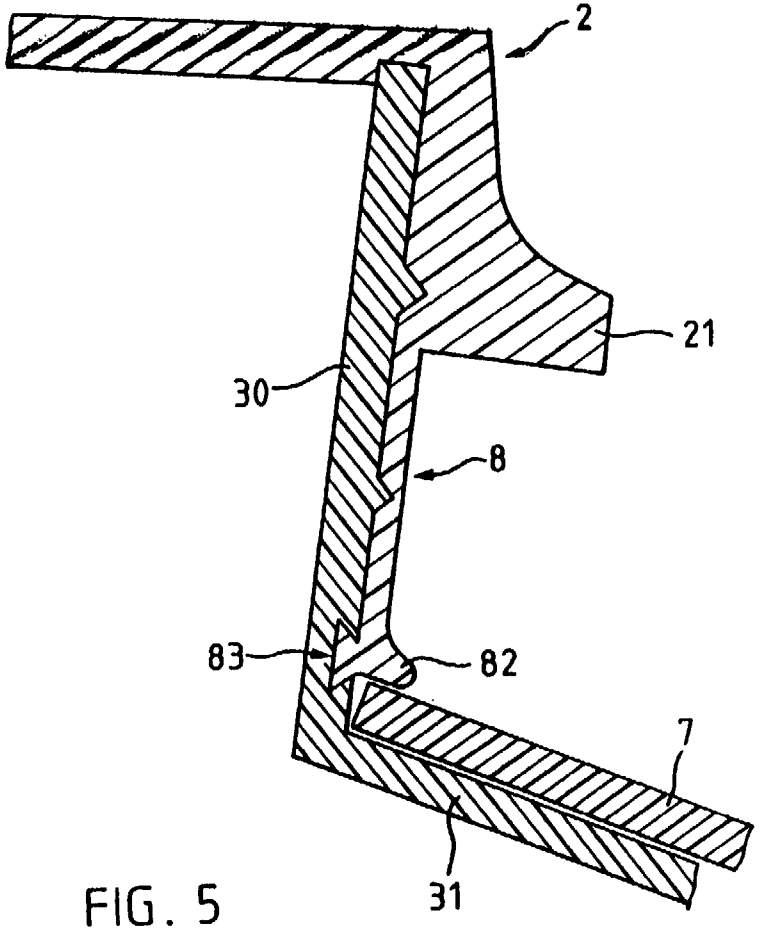

FIG. 5 shows, in the same section as FIG. 4, a further exemplified embodiment of an indicator 8, which carries also a cam 82 serving for the positioning of the unit on the container. It differs, however, from the embodiment according to FIG. 4 as the indicator 8 does not have an anchorage extending between the base and the container wall but is anchored by an interlocking connection 83 on the spout 30 itself. The interlocking connection 83 consists substantially of a shaped-in portion in the spout 30 (first material) which is filled in the molding process by the second material.

Figure 6:
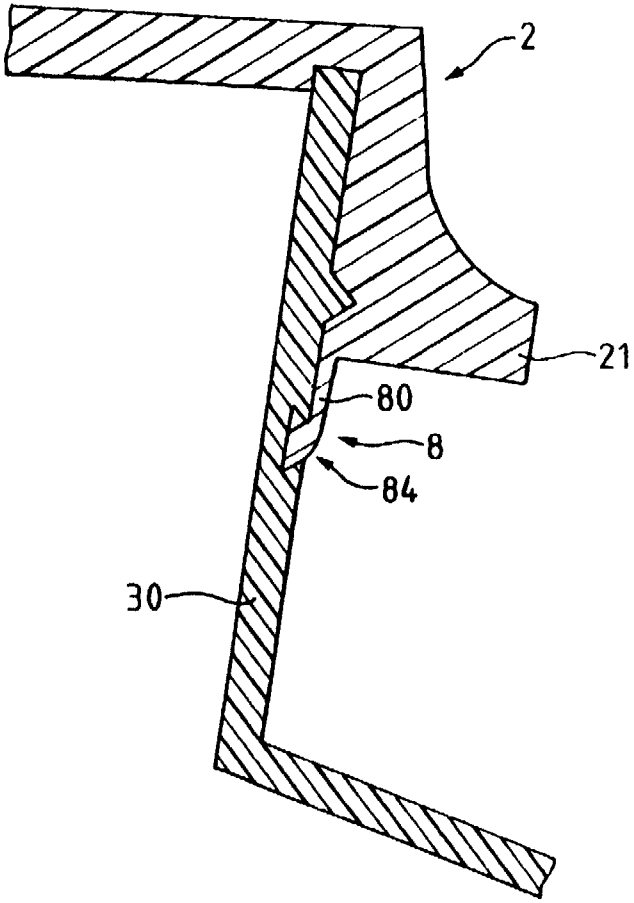
FIG. 6 is an embodiment of an indicator with a disconnectable anchorage, in section.

FIG. 6 shows, again in the same section as FIG. 4, a further embodiment of the indicator 8. The indicator shows again a web 80 shaped onto the closure part 2, in the region of the lip 21. The web 80 is connected to the spout 30 by an interlocking connection 84. The embodiment differs from the already described embodiments in that the web 80 does not have a predetermined breaking point. Instead, the interlocking connection 84 is so designed that the force used for its disconnection is small. On first opening the closure unit the interlocking connection 84 between web 80 and spout 30 is disconnected. The interlocking connection is designed in such a way that it cannot, at least with simple means, be reconnected.

The interlocking connection is a formed-in portion of the outer surface of the spout forming a hole, which is filled with the second material in the molding process. If the opening of this hole is sufficiently more narrow than its inner parts, the connection once disconnected cannot be reconnected.

Figure 7:
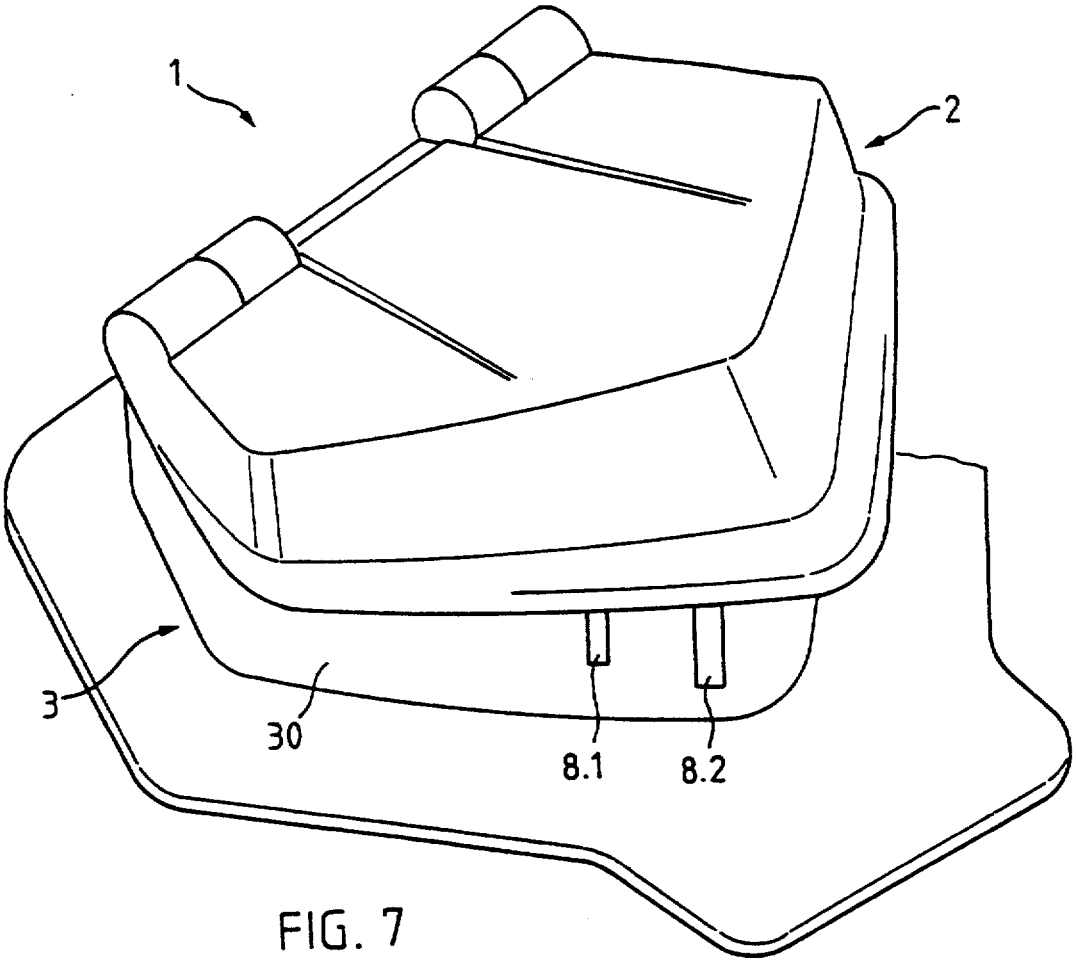
FIGS. 7 to 9 are further embodiments of indicators with disconnectable anchorage in perspective view (FIG. 7) and in section parallel to the pouring opening (FIGS. 8 and 9)
Figure 8:
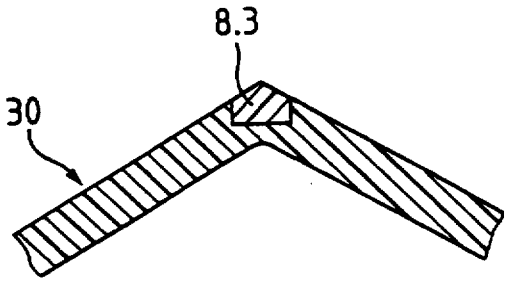
Figure 9:
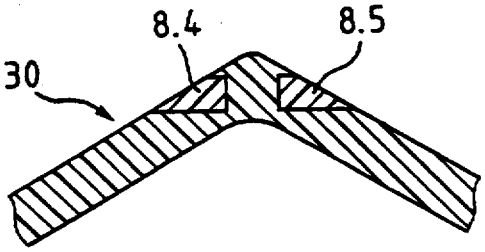

FIGS. 7 to 9 show further exemplified embodiments of indicators which are connected to the spout 30 by an interlocking connection which is disconnected at first opening the closure unit. For these embodiments the interlocking connections are not reconnectable not because of their particular form, but because the web is designed to have so little stiffness that it cannot be positioned exactly and therefore the connection cannot be reconnected. Furthermore there is a high probability that the web will be deformed on first disconnection of the connection which is a further cause for the connection not being reconnectable.

FIG. 7 shows a closure unit with such indicators in perspective view. The indicators 8.1 and 8.2 are shaped onto the closure part 2 and lie in corresponding grooves in the spout 30. On first opening the closure unit, the indicators are pulled out of the grooves. As they are very thin, they are not stiff enough for being reintroduced into the grooves on reclosing the unit.

FIGS. 8 and 9 show in section parallel to the pouring opening further embodiments of indicators as shown in FIG. 7. FIG. 8 shows an indicator 8.3 which lies in a groove of the spout 30 and is positioned substantially in the plane of symmetry (6 in FIG. 1) of the closure unit. FIG. 9 shows two such indicators 8.4 and 8.5 in grooves positioned symmetrically to the plane of symmetry. In the same way grooves and corresponding webs may be arranged anywhere at the surface of the spout 30. The webs do not necessarily have to be long and narrow as indicated by the figures, they may have different forms as long as they show at least one area with a reduced cross section which reduces their stiffness such that once pulled out of the corresponding groove they cannot be reintroduced.

Figure 10:
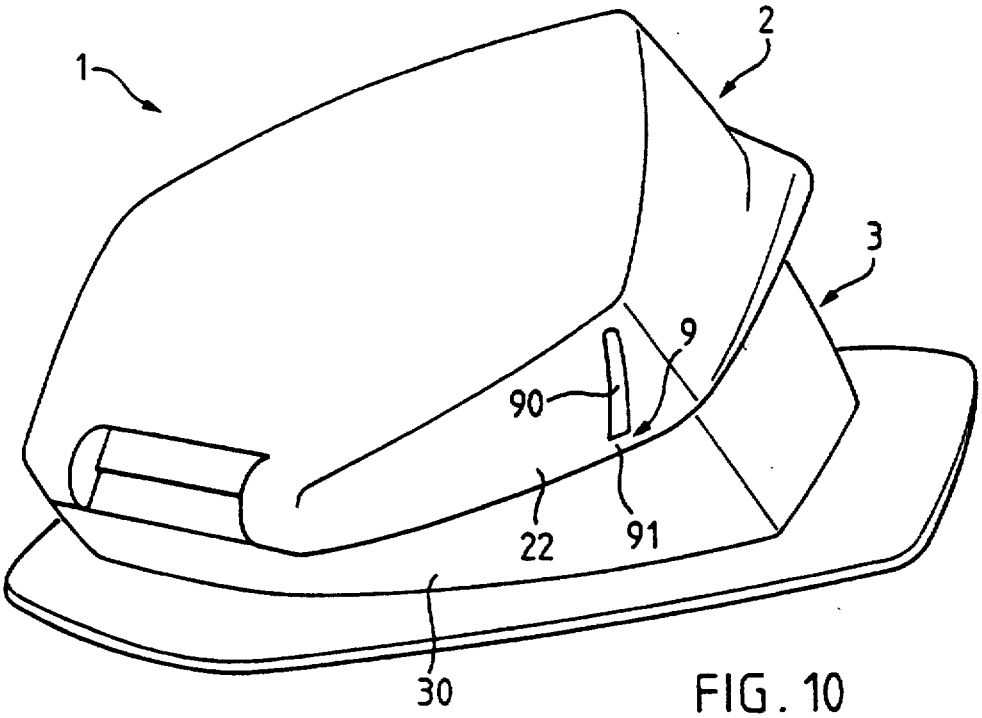
FIGS. 10 and 11 are an exemplified embodiment of an indicator without anchorage in a new state (FIG. 10) and in a reclosed state (FIG. 11).
Figure 11:
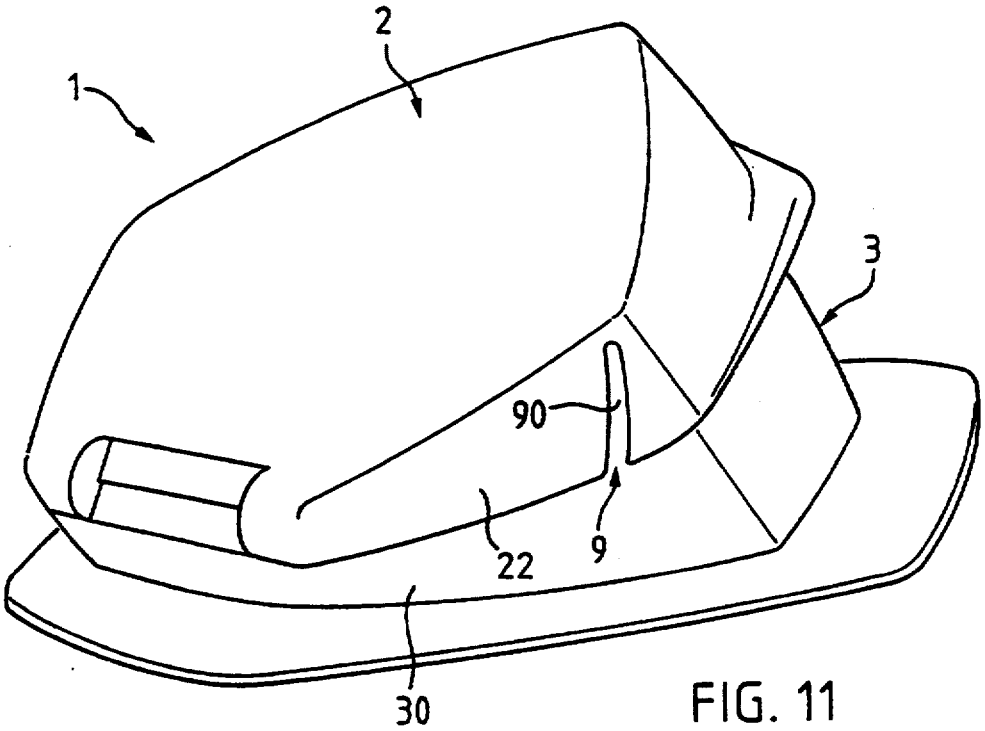

FIGS. 10 and 11 show a further exemplified embodiment of the closure unit with indicator according to the invention. The indicator 9 consists of a predetermined breaking point in the accordingly shaped closure part 2, which predetermined breaking point is ruptured by the deformation of the closure part which is unavoidable on opening the closure unit. The predetermined breaking point is positioned in an area of the closure part 2 that is not included in the closing or sealing function. Therefore this function is not impaired by the breaking of the indicator on first opening the unit.

FIG. 10 shows such a breaking point intact, which is when the closure unit is new. FIG. 11 shows it in a broken state. The predetermined breaking point is, as shown in the figures, formed by a slot 90 in the area of the closure part 2 which overlap the spout 30. The slot 90 is closed towards the edge of the closure part by a narrow bridge 91, which constitutes the actual point for the breakage. In this last case as in all other cases the visibility of the state of the indicator 9 is greatly enhanced by a difference in color between the indicator and the spout surface.

What is claimed is:

1. Closure unit, made from thermoplastic synthetic material, for a container for handling and storing flowable products, comprising:

a pouring part (3) with a substantially tubular spout (30), said pouring part having:

an opening therein; and a base (31) for affixing said pouring part to the container; and a closure part (2) closing said opening in said pouring part;

and wherein:

said closure unit has at least two areas, each area being made from a respective single material, wherein the single material of one area differs from the single material of another area in at least one characteristic;

the closure part (2) has an indicator web (80) which belongs to one of said areas of a single material and extends over a region of an outer surface of the spout (30) belonging to another of said areas of another single material, and said indicator web is shaped so that on first opening the closure unit said indicator is irreversibly brought from a first state into a second state; and said indicator web (80) extends from said closure part (2) towards the base (31), is fixed to the spout (30) by means of a permanent interlocking connection, and has a predetermined breaking location (85).

2. Closure unit according to claim 1, wherein said indicator web (80) extends into a formed-in section of an outer surface portion of the spout (30).

3. Closure unit according to claim 2, wherein said formed-in section is a hole with a narrowed opening towards an outside of the closure unit.

4. Closure unit according to claim 1, wherein said indicator web comprises a predetermined breaking location in the closure part (2) arranged in a portion of the closure part (2) which overlaps the spout (30).

5. Closure unit according to claim 4, wherein said predetermined breaking location is formed by a slot (90), which is closed towards the edge of the closure part (2) by a narrow bridge (91).

6. Closure unit, made from thermoplastic synthetic material, for a container for handling and storing flowable products, comprising:

a pouring part (3) with a substantially tubular spout (30), said pouring part having:

an opening therein; and a base (31) for affixing said pouring part to the container; and a closure part (2) closing said opening in said pouring part;

and wherein:

said closure unit has at least two areas, each area being made from a respective single material, wherein the single material of one area differs from the single material of another area in at least one characteristic;

the closure part (2) has an indicator web (80) which belongs to one of said areas of a single material and extends over a region of an outer surface of the spout (30) belonging to another of said areas of another single material, and said indicator web is shaped so that on first opening the closure unit said indicator is irreversibly brought from a first state into a second state; and said indicator (80) extends from said closure part (2) to the base (31), said indicator web (80) is fixable between a container wall (7) and the base (31) by means of an anchorage (81), and has a predetermined breaking location (85).

7. Closure unit according to claim 6, wherein the predetermined breaking location (85) is a location of reduced cross section and is situated in the middle part of the length of the web (80).

8. Closure unit according to claim 6, wherein said location of reduced cross section is produced by a cam (15) on the spout surface.

9. Closure unit according to claim 6, wherein said indicator web (80) includes a positioning cam (82) for positioning the closure unit on a container.

10. Closure unit according to claim 6, wherein said closure part (2) has an opening lip (21), and a plurality of said indicator webs are shaped onto said opening lip.

11. Closure unit according to claim 6, wherein said indicator web is arranged substantially in a plane of symmetry (6) of the closure unit.

12. Closure unit according to claim 6, wherein the predetermined breaking location is a location of reduced cross-section and is situated in the web (80) at an edge of the closure part (2).

13. Closure unit according to claim 7, wherein said location of reduced cross-section is produced by a depression (10) in the web (80).

14. Closure unit, made from thermoplastic synthetic material, for a container for handling and storing flowable products, comprising:

a pouring part (3) with a substantially tubular spout (30), said pouring part having:

an opening therein; and a base (31) for affixing said pouring part to the container; and a closure part (2) closing said opening in said pouring part;

and wherein:

said closure unit has at least two areas, each area being made from a respective single material, wherein the single material of one area differs from the single material of another area in at least one characteristic;

the closure part (2) has an indicator web (80) which belongs to one of said areas of a single material and extends over a region of an outer surface of the spout (30) belonging to another of said areas of another single material, and said indicator web is shaped so that on first opening the closure unit said indicator is irreversibly brought from a first state into a second state; and said indicator (8, 8.1 . . . 8.5) is fixed to the pouring part (3) by affixation means which are disconnectable but not reconnectable.

15. Closure unit according to claim 14, wherein said indicator (8.1, 8.2, 8.3, 8.4, 8.5) comprises a web element shaped to fit onto the closure part (2) and positioned in a corresponding groove on the outer surface of the spout (30), which web element is dimensioned so that it does not have enough stiffness to be repositioned into the groove.

* * * * *